United States Patent [19]

Cairns

[11] 4,085,993

[45] Apr. 25, 1978

[54] SEALED CONNECTOR WITH BARRIERS TO CONTACT BRIDGING

[76] Inventor: James L. Cairns, 16946 Cloudcroft Dr., Poway, Calif. 92064

[21] Appl. No.: 720,846

[22] Filed: Sep. 7, 1976

[51] Int. Cl.[2] ..... H01R 13/52

[52] U.S. Cl. ..... 339/94 M; 339/117 R

[58] Field of Search ..... 339/94, 96, 117 R, 118 R

[56] References Cited

U.S. PATENT DOCUMENTS

| | | | |
|---|---|---|---|
| 3,456,232 | 7/1969 | Dupre | 339/96 |
| 3,643,207 | 2/1972 | Cairns | 339/96 |

*Primary Examiner*—Joseph H. McGlynn
*Attorney, Agent, or Firm*—Perry E. Turner

[57] ABSTRACT

A plug with blade type contacts is shown in which such contacts enter a receptacle via self-sealing slits to matingly engage contacts in a dielectric filled chamber wherein adjacent receptacle contacts, and hence adjacent plug contacts engaging them, are separated by plates extending radially from a central flexible member to the chamber wall. The plates in the example shown are integral with a central sleeve or tube, and are prevented from movement out of contact separating position via interference relations of portions of the plates and portions of the receptacle housing or contacts. For foreign conductive matter entering the fluid and which might otherwise be able to bridge adjacent contacts, the plates constitute barriers to prevent such bridging and degradation of electrical integrity that would occur therefrom. For pressure compensation in use of plates and tube that are rigid, holes are provided in the lateral surface of the tube intermediate adjacent plates.

7 Claims, 5 Drawing Figures

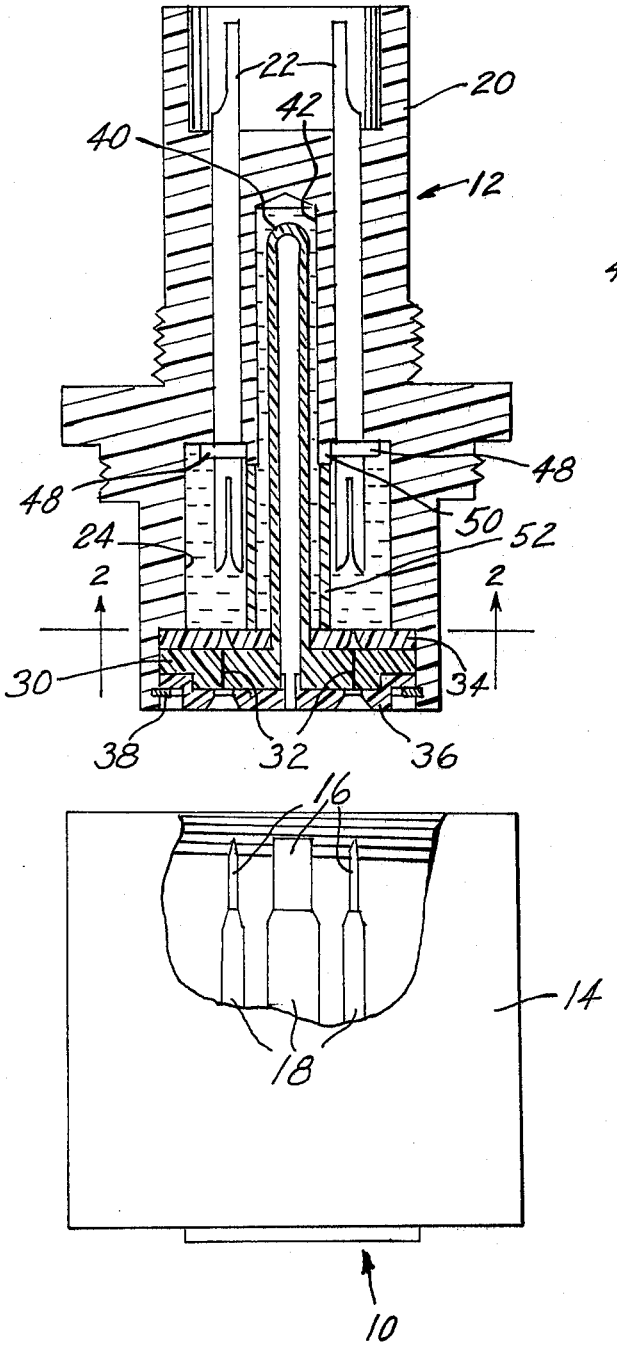
FIG. 1
FIG. 2
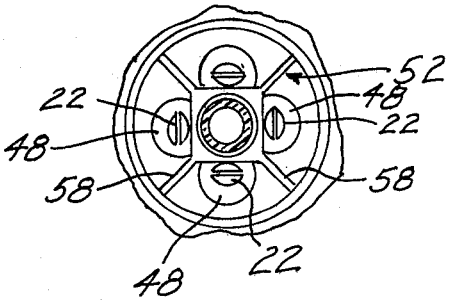
FIG. 3
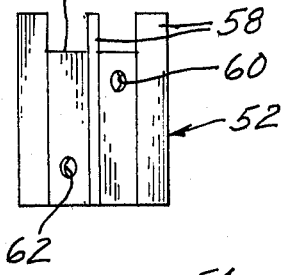
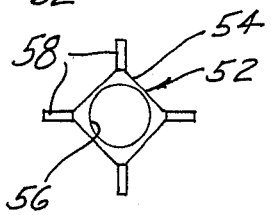
FIG. 4
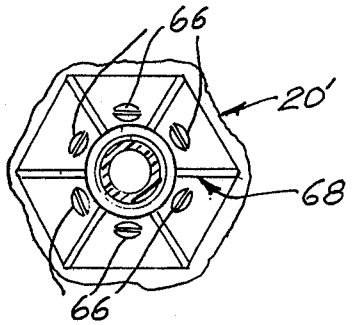
FIG. 5

SEALED CONNECTOR WITH BARRIERS TO CONTACT BRIDGING

BACKGROUND OF THE INVENTION

1. Field of the Invention

This invention relates to sealed electrical connectors for use in making connections in water, an explosive atmosphere, or other adverse environment.

2. Description of the Prior Art

This invention is an improvement over the connector of my U.S. Pat. No. 3,643,207, "Sealed Electrical Connector," issued Feb. 15, 1972. The connector disclosed in said patent includes a receptacle in which the contacts are in a dielectric fluid captured in a container that has a slitted, self-sealing cap closure structure. The plug carries blade-type contacts to be forced through the slits and into firm mating engagement with the receptacle contacts. The structure permits the plug contacts to be wiped by the cap as they enter and leave the receptacle, and the dielectric fluid remains captured. Pressure compensation is achieved via a flexible boot that is integral with the cap closure and has its interior exposed to the surrounding medium via a central opening in the cap closure.

Such a connector as heretofore known makes possible the shorting of adjacent contacts by a foreign conductive matter that enters the dielectric fluid in the receptacle. For example, salt water that is inadvertently permitted to enter the dielectric fluid, e.g., silicone oil, does not mix with or disperse in the fluid. Rather, it remains substantially intact. Thus, a few drops of salt water can move against and wet adjacent contacts. Since the salt water is conductive, it causes severe undesired electrical degradation of operation of the connector.

SUMMARY OF THE INVENTION

This invention embraces a sealed electrical connector of the type disclosed in said patent, with means providing barriers respectively located between adjacent contacts in the receptacle and extending from the flexible pressure-compensating boot to the chamber wall, and means to prevent movement of the barrier means out of contact-separating position. Also embraced are flexible and rigid barrier means, including a tube with integral radial plates surrounding the boot, and interfering portions of the receptacle housing and barrier means, and of the receptacle contacts and barrier means, to prevent rotation of any barrier from between adjacent contacts, whereby the barriers prevent an electrically conductive contaiminant entering the dielectric fluid from contacting and spanning adjacent ones of the contacts separated thereby.

BRIEF DESCRIPTION OF THE DRAWING

FIG. 1 is a longitudinal sectional view of a sealed electrical connector in accordance with this invention;

FIG. 2 is a sectional view taken along the line 2—2 of FIG. 1;

FIG. 3 is a side elevation view of the barrier means of the embodiment of FIG. 1;

FIG. 4 is a top view of the separator of FIG. 4; and

FIG. 5 is a sectional view like FIG. 2 but for an embodiment employing six contacts, to aid in explaining the scope of the invention.

DESCRIPTION OF ILLUSTRATIVE EMBODIMENTS

Referring to FIG. 1, a sealed connector is shown that includes a plug 10 and receptacle 12, and a locking member 14 to capture the plug and be threaded onto the receptacle and thus secure the plug and receptacle together. As disclosed in my U.S. Pat. No. 3,643,207, the plug has spaced blade-type contacts 16 coated at 18 with sealing material such as Teflon. The receptacle 12 has a body 20 in which elongated conductive contacts 22 are secured. The portions of the contacts 22 to be matingly engaged by the blade contacts 16 of the plug are forked, with the slot being sufficiently narrow to require the plug contacts to firmly and frictionally engage the receptacle contacts.

The forked ends of the receptacle contacts 22 are located in a sealed chamber 24. Such chamber is sealed by virtue of a cap closure structure comprised of a disc 30 that is slit at 32 at each entry point for a plug contact, such disc 30 being sandwiched between backing discs or plates 34, 36, the inner plate being lodged against an inner shoulder of the housing 20, and the outer plate 36 being held in position via a retaining ring 38.

Pressure compensation is achieved via a flexible boot 40 that is integral with the slitted disc 30. As shown, the body 20 has an inner bore 42 to accommodate the length of the boot 40. The interior of the boot is exposed to the medium outside the receptacle, for the purpose of which the outer backing plate 36 has a central opening leading from the boot to the exterior. The chamber 24 is filled with a dielectric fluid indicated as a liquid, but which may be a grease, oil or gel, all as explained in the aforementioned patent.

Prevention of the spanning and shorting of adjacent contacts 22, and hence of adjacent contacts 16 of the plug when plug and receptacle are mated, by a conductive contaminant that may enter the fluid in chamber 24 is effected in a four-contact connector via a separator which is generally cruciform in cross-section. Referring to FIGS. 2–4 along with FIG. 1, the contacts 22 have enlarged flange portions 48 seated against the body 20 at the inner portion of the chamber 24 that surrounds the boot 40 and bore 42. The body has a boss projection 50 (FIG. 1) around which the flanges 48 are disposed, and the inner portions of such flanges are flat surfaces abutting flat surfaces of the boss 50.

Extending between the boss 50 and the inner backing plate 34 is a separator 52 which in one form has a central tube or sleeve from which blades or plates radiate. Referring to FIGS. 2–4, the separator 52 has a central tube 54 that has a substantially square lateral surface, and a cylindrical bore 56. The blades or plates 58 in this example extend from the diagonals, i.e., the corners, of the tubular element 54. Also, the blades at one end extend past the tubular element 54, to allow the separator 52 to be seated with boss 52 straddled by the blade extensions. Thus oriented, the blade extensions are disposed between adjacent flanges 48 of the contacts 22. Thus, the flanges of the contacts and the blades of the separator are in interference relation, so that the separator cannot be turned and moved from the position wherein each blade is retained as a barrier between adjacent contacts, thereby to prevent a foreign conductive contaminant that may enter the dielectric fluid from making a direct bridge between adjacent contacts.

In this latter regard, it is to be understood that the foreign conductive matter is most likely to be composed of the medium in which the connector is used. Thus, for connectors used in the ocean, the contaminant is sea water. The dielectric fluid used is of a type, e.g., silicone oil, in which droplets of sea water do not disperse but remain substantially intact. In the absence of the separator having respective blades between adjacent contacts, a sufficient quantity of sea water could readily span the space directly between two contacts and seriously adversely affect the electrical operations intended to be achieved.

However, the separator blades present a uniquely advantageous physical, nonconductive barrier between the contacts so as to prevent such shorting thereof by such contaminants. Thus, a quantity of sea water entering the fluid will enter between adjacent blades and thus be trapped in the vicinity of a single contact. Since there is not any conductive path via the sea water, there is no damage and no affect on the desired electrical operations.

The separator used in one example is made of rigid plastic. For such separators, pressure compensation is achieved by providing openings 60, 62 through the central tubular portion 54 (FIG. 2). Such openings are sized to achieve pressure compensation without permitting passage of the contaminant directly between adjacent contacts. Still further, such passage is also thwarted by making the openings 60, 62 in adjacent walls axially displaced.

FIG. 5 illustrates an arrangement for making connections through six contacts 66. In this embodiment, the receptacle body 20' has a sealed chamber with a hexagonal wall. A separator 68 has blades extending to the corners of each wall facet, with each pair of blades isolating a respective contact from an adjacent contact. The central tubular portion of such a separator preferably has a central bore for surrounding the flexible boot. Because of the shape of the chamber wall and the locations of the blades of the separator, the receptacle housing and the separator blades are in interference relation so that there can be no turning of the separator out of contact-separating position.

I claim:

1. In combination:

a plug having contacts to enter a receptacle and matingly engage contacts therein;

a receptacle including a housing having a chamber sealed by a slitted, self-sealing cap, said chamber being filled with dielectric fluid;

a hollow flexible member integral with said cap extending into said chamber, said cap having a central opening to expose the interior of said flexible member to the exterior of said housing;

electrical contacts spaced about said flexible member and secured in said housing opposite said cap;

respective barrier means extending from said flexible member and between each pair of said electrical contacts, each barrier means being dimensioned to prevent any foreign conductive matter entering said fluid from spanning the electrical contacts separated thereby;

and means to prevent movement of any of said barrier means out of contact separating position.

2. The combination of claim 1, wherein each barrier means extends between the wall of said chamber and said flexible member.

3. The combination of claim 1, including a tubular element surrounding said flexible member, and each barrier means being a plate integral with and extending radially from said tubular element.

4. The combination of claim 3, wherein said contacts in said housing have portions in interfering relation with the adjacent plates to keep them in contact separating position.

5. The combination of claim 3, wherein said housing and said tubular element have portions in interfering relation for keeping said plates in contact separating position.

6. The combination of claim 3, wherein said tubular element and plates constitute a rigid member, said tubular element having holes therethrough intermediate said plates.

7. The combination of claim 6, wherein holes in said tubular element on opposite sides of each plate are axially spaced along said tubular element.

* * * * *